United States Patent [19]

Bernier

[11] Patent Number: 4,735,124

[45] Date of Patent: Apr. 5, 1988

[54] PEG BOX FOR STRINGED INSTRUMENTS

[76] Inventor: Michel M. Bernier, 42, St-Michel, St-Elie-d'Orford, Quebec, Canada, J0B 2S0

[21] Appl. No.: 83,064

[22] Filed: Aug. 10, 1987

[51] Int. Cl.[4] ..... G10D 3/14

[52] U.S. Cl. ..... 84/304; 84/297 R

[58] Field of Search ..... 84/274, 293, 297 R, 84/304, 305, 306, 312

[56] References Cited

U.S. PATENT DOCUMENTS

| | | | |
|---|---|---|---|
| 1,336,409 | 4/1920 | Ashley | 84/297 R |
| 4,041,830 | 8/1977 | Doane | 84/305 |
| 4,304,164 | 12/1981 | Baker | 84/277 |

FOREIGN PATENT DOCUMENTS

| | | | |
|---|---|---|---|
| 52098 | 8/1936 | Denmark | 84/274 |

*Primary Examiner*—Lawrence R. Franklin

*Attorney, Agent, or Firm*—Ronald L. Morneau

[57] ABSTRACT

A peg box for a stringed instrument adapted to facilitate the introduction of the musical strings in the aperture of the tuning pegs. The peg box is made of a solid beam of material having a flat upper face and transversal channels for rotatably receiving the pegs. Bores extend from the upper face of the beam to the channels. Diametral apertures in the tuning pegs are aligned with the bores according to a predetermined reference mark. The musical strings are easily introduced into the bores and are automatically aligned with the apertures of the pegs. The threading of the musical strings is facilitated and made even easy for a blind person.

7 Claims, 1 Drawing Sheet

PEG BOX FOR STRINGED INSTRUMENTS

BACKGROUND OF THE INVENTION

1. Field of the Invention

The invention relates to a peg box for stringed instruments which facilitate the introduction of the musical strings on the tuning pegs. The peg box is made of a solid piece of material having an upper face provided with bores for guiding the strings towards the apertures in the pegs.

2. Prior Art

The prior art discloses peg boxes which have a U-shaped cross-section such in U.S. Pats. Nos. 4,005,628, 3,726,172 and 3,459,092. The tuning pegs are crossing the peg box at a level somewhat below the upper surface of U-shape inside a narrow channel which makes it difficult to insert the strings in the aperture of the peg. This is particularly so, for the peg adjacent the volute of the instrument where the channel is even narrower and somewhat recedes under the usual volute.

SUMMARY OF THE INVENTION

The peg box according to the present invention is made of a solid piece of material which has a substantially flat face. The tuning pegs which extends crosswise in the peg box are contiguous with the upper portion of the peg box. Diametrical apertures provided in the pegs are adapted to be aligned with bores provided through the upper portion of the peg box to facilitate the winding of the musical strings on the pegs. The bores and the aperture are provided with bevels to improve the insertion of the strings therein. The pegs have a peripheral groove in the plane of the aperture to provide space for the wound strings.

DETAILED DESCRIPTION OF THE INVENTION

Figure 1:
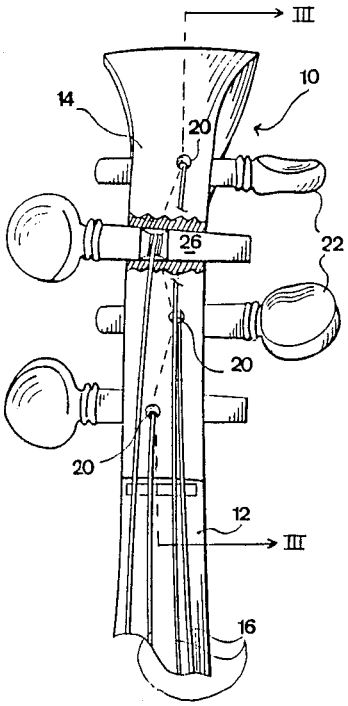
FIG. 1 is a top view of a peg box according to the invention with a portion of the handle of a violin.
Figure 2:
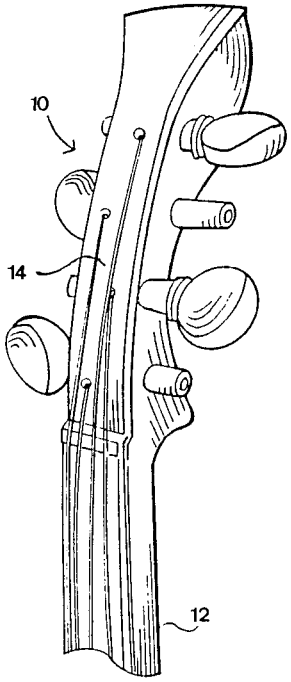
FIG. 2 is a perspective view of the peg box shown in FIG. 1.
Figure 3:
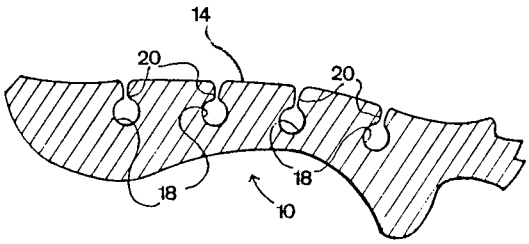
FIG. 3 is a cross-sectional view of the peg box taken along line III—III of FIG. 1.

In FIGS. 1 and 2, the peg box 10 is integrally formed with the handle 12. The peg box 10 is made of a solid piece of hard material which fills completely its inner space as shown in FIG. 3. The material used is a hard wood such as maplewood and because it integrally extends from the handle 12, both may be made out of one piece of maplewood. For some instruments, the handle 12 and the peg box 10 are made of hard plastic, fiberglass or a core of hard wood surrounded by a hard plastic. An unsaturated polyester resin known by the trademark GELCOAT and produced by Armkem Inc. is a particularly suitable material.

The peg box 10 has a substantially flat upper surface 14 crosswise and slightly curved lengthwise for allowing the strings 16 to rest evenly. Four transversal channels 18 are perforated through the peg box at a level slightly below the upper surface 14. The distance between the upper surface 14 and the upper periphery of the channels 18 is about ⅛ to ¼ inch. The cross-section of the channels 18 is circular and the channels are tapered from one end to the other. A bore 20 extends between the top surface 14 and the channels 18. The diameter of the bores 20 allows the passage of a musical string and is about 1/16 inch. The portion of the bore 20 adjacent the top surface 14 is beveled at about 45 degrees to widen the opening of the bore to about ⅛ inch. It is easy to introduce a musical string in one of the bores 20 because the latter emerges on the top surface 14 of the peg box 10. The introduction of the string is further facilitated by the beveled portion of the bore. This operation is made so easy that even a blind person can feel the bore and insert the string into it.

Figure 4:
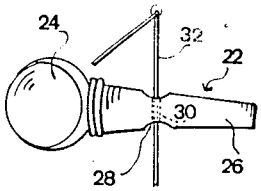
FIG. 4 is a top view of a peg including a musical string.

A peg 22 such as illustrated in FIG. 4 is inserted in each bore 18. A peg 18 comprises a head piece 24, a frusto-conical spindle 26 having a peripheral circular groove 28 crossed by a diametrical aperture 30. The spindle 26 has a tapered shaped corresponding to the channel 18 of the peg box 10 for the usual purpose of tightening the tuning peg in the channel. The groove 28 is intended to leave a space for the end of the string 32 which needs to be wound on the peg. This space is needed because the peg box is completely filled contrary to the usual peg box described in the patents referred to in the background section of this application. The aperture 30 provided through the groove 28 is about 1/16 inch in diameter and is beveled at both ends like the bores 20. The aperture 30 may be aligned with the bore 20 by placing identification means on the side of the peg box 10 and on the peg 22. Such identification means may be engraved in a manner acceptable by blind people. One suitable method for aligning the aperture 30 with the bore 20 consists in forming the peg with a substantially flat head piece 24 and drilling the aperture 30 in an axis corresponding to the plane of the head piece 24 as illustrated in FIG. 4. It is easy to make the plane of the head piece 24 correspond to the axis of the bore 20 which are approximately perpendicular relative to the top surface 14 of the peg box. This procedure can be accomplished by a blind person because the upper outlet of the bore can be felt by the fingers while the head piece 24 is oriented according to a predetermined position.

It should be understood that this invention is applicable to variety of string instruments such as violin, cello, double-bass, etc.

Although, the peg box according to the invention can be integrally formed with the handle, it can be substituted on already string instruments or whenever a peg box has been broken.

What is claimed is:

1. A peg box for tightening musical strings of a stringed instrument having a handle, the said peg box being integrally extending from said handle, the said peg box being characterized by a solid beam member having a substantially flat upper face, the said beam member being provided by transversal channels for laterally receiving tuning pegs, fine bores extending from said upper face to each of said channels for allowing passageway of said musical strings from said upper face to said tuning pegs.

2. A peg box as recited in claim 1, wherein the said beam member is bevelled around the bores adjacent the said upper face.

3. A peg box as recited in claim 2, wherein the said channels are tapered, a tuning peg having a frusto-conical spindle rotatably mounted in each of said channel, each of said spindles having an aperture across its diameter adapted to be aligned with the said bore, whereby a musical string introduced in said bore is adapted to be automatically aligned with and introduced into said aperture.

4. A peg box as recited in claim 3, wherein said tuning pegs are bevelled at each end of said apertures.

5. A peg box as recited in claim 4, wherein the said pegs are grooved along a plane corresponding to the plane of the apertures.

6. A peg box as recited in claim 3, wherein the said peg has a head piece extending from said spindle, the said head piece being substantially flat to define a plane, the plane of said head piece being in line with the axis of said aperture in the spindle.

7. A peg box as recited in claim 1, the said peg box being made of a material selected from hard wood, hard plastic, fiberglass or a combination thereof.

* * * * *